US007932468B2

(12) United States Patent
Takano et al.

(10) Patent No.: US 7,932,468 B2
(45) Date of Patent: Apr. 26, 2011

(54) INSULATED ELECTRIC WIRE

(75) Inventors: Yuji Takano, Mito (JP); Hideyuki Kikuchi, Hitachi (JP); Takahiko Hanada, Hitachi (JP); Kenji Asano, Hitachi (JP); Tomiya Abe, Hitachi (JP); Akira Setogawa, Hitachi (JP)

(73) Assignees: Hitachi Magnet Wire Corp., Ibaraki (JP); Hitachi Cable, Ltd., Tokyo (JP)

( * ) Notice: Subject to any disclaimer, the term of this patent is extended or adjusted under 35 U.S.C. 154(b) by 0 days.

(21) Appl. No.: 12/684,493

(22) Filed: Jan. 8, 2010

(65) Prior Publication Data

US 2010/0218972 A1 Sep. 2, 2010

(30) Foreign Application Priority Data

Feb. 27, 2009 (JP) ..... 2009-045900

(51) Int. Cl.
*H01B 7/00* (2006.01)

(52) U.S. Cl. ..... 174/110 R; 174/36

(58) Field of Classification Search ..... 174/36, 174/110 R, 113 R, 120 R, 120 SC, 126.1, 174/126.2

See application file for complete search history.

(56) References Cited

U.S. PATENT DOCUMENTS

| | | | | |
|---|---|---|---|---|
| 4,477,624 | A * | 10/1984 | Waki | 524/736 |
| 2002/0123571 | A1* | 9/2002 | Reynolds et al. | 525/178 |
| 2006/0240255 | A1* | 10/2006 | Kikuchi et al. | 428/375 |
| 2009/0202831 | A1* | 8/2009 | Honda et al. | 428/383 |

FOREIGN PATENT DOCUMENTS

| | | |
|---|---|---|
| JP | 07-134912 | 5/1995 |
| JP | 09-045143 | 2/1997 |
| JP | 2007-213908 | 8/2007 |

* cited by examiner

*Primary Examiner* — William H Mayo, III

(74) *Attorney, Agent, or Firm* — Scully, Scott, Murphy & Presser, PC

(57) ABSTRACT

An insulated electric wire is composed of a conductor, and a lubricating layer containing a lubricant. The lubricating layer is formed around the perimeter of the conductor. The lubricating layer is not less than 0.06 and not more than 0.12 in an absorbance ratio A1/A2 expressed by an absorbance A1 of carbon-hydrogen stretching vibration and an absorbance A2 of benzene ring framework vibration, obtained by Fourier Transform Infrared Spectroscopy analysis of a surface of the lubricating layer.

5 Claims, 1 Drawing Sheet

INSULATED ELECTRIC WIRE

The present application is based on Japanese patent application No. 2009-045900 filed on Feb. 27, 2009, the entire contents of which are incorporated herein by reference.

BACKGROUND OF THE INVENTION

1. Field of the Invention

The present invention relates to an insulated electric wire with excellent coil insertability.

2. Description of the Related Art

Motors, transformers or the like are formed by, for example inserting plural insulated electric wire coils into a stator slot, and then welding ends of the plural coils inserted to each other.

The coils are formed by high-speed coiling insulated electric wires. To reduce flaws caused in the insulated electric wire surface during the coil formation, the coils are therefore required to have an excellent coilability, i.e., an enhanced lubricity of the insulated electric wire surface.

To improve the lubricity of the insulated electric wires, it has been suggested to, for example apply to their insulating layer a resin coating with a lubricant, such as a polyethylene oxide, added to its base resin, and bake it to form a lubricating layer (insulating sheath layer). Refer to JP-A-2007-213908, for example.

Also, it has been suggested to apply to a conductor a resin coating with a stabilized isocyanate compound and a lubricant combined into its base resin, and bake it to form a lubricating layer (refer to JP-A-9-45143, for example), or apply to a conductor a resin coating with a titanate ester combined into its base resin, and bake it to form a lubricating layer (refer to JP-A-7-134912, for example).

Refer to JP-A-2007-213908, JP-A-9-45143 and JP-A-7-134912, for example.

In recent years, on the other hand, motors or transformers have been required to have a high efficiency from an energy saving point of view. To this end, the coils are inserted into the stator slot with little space left therein, to increase the ratio (fill factor) of the conductor cross-sectional area of the insulated electric wires to the stator slot cross-sectional area. Therefore, to reduce flaws caused in the insulated electric wire surface during the coil insertion, the insulated electric wires are required to have an excellent coil insertability, i.e., a reduced coil insertion force required to insert the coils into the stator slot.

However, the conventional insulated electric wires are insufficient in coil insertability. Therefore, to improve this coil insertability, a large amount of lubricant to add to the insulating coating is used, thereby leading to a cloudy coating (lubricating layer), or a poor appearance, such as a foamy, granular, rough, or hollow coating surface.

SUMMARY OF THE INVENTION

Accordingly, it is an object of the present invention to provide an insulated electric wire, which obviates the above problem, and which thereby has an excellent coil insertability, and a cloudless coating and a flawless appearance.

(1) According to one embodiment of the invention, an insulated electric wire comprises:

a conductor; and a lubricating layer containing a lubricant, being formed around a perimeter of the conductor, and being not less than 0.06 and not more than 0.12 in an absorbance ratio A1/A2 expressed by an absorbance A1 of carbon-hydrogen stretching vibration and an absorbance A2 of benzene ring framework vibration, obtained by Fourier Transform Infrared Spectroscopy analysis of a surface of the lubricating layer.

In the above embodiment (1), the following modifications and changes can be made.

(i) The lubricating layer is not less than 7% and not more than 70% in an effective lubricating area of a surface thereof.

(ii) The lubricating layer comprises the lubricant, a titanate coupling agent, and a cross-linking agent, each added to a base resin.

(iii) The cross-linking agent comprises a polyisocyanate compound terminated with isocyanate groups not stabilized by a masking agent.

(iv) A mass ratio of the titanate coupling agent and the cross-linking agent is 1:10 to 1:200.

Points of the Invention

According to one embodiment of the invention, an insulated electric wire is not less than 0.06 and not more than 0.12 in the absorbance ratio A1/A2 expressed by the absorbance A1 of carbon-hydrogen stretching vibration and the absorbance A2 of benzene ring framework vibration, obtained by Fourier Transform Infrared Spectroscopy analysis of surface of the lubricating layer. The absorbance ratio A1/A2 not less than 0.06 can inhibit insufficient lubricant bleed over the surface of the lubricating layer, or lubricant thermolysis during baking, therefore allowing the lubricating layer to be formed to have a sufficient surface lubricity, and thereby make the coil insertability good. Also, the absorbance ratio A1/A2 not more than 0.12 can prevent excessive lubricant presence over the surface of the lubricating layer, therefore allowing realization of the insulated electric wire with a good appearance. Accordingly, the absorbance ratio A1/A2 not less than 0.06 and not more than 0.12 allows realization of the insulated electric wire with an excellent coil insertability, and a cloudless coating and a flawless appearance.

BRIEF DESCRIPTION OF THE DRAWINGS

The preferred embodiments according to the invention will be explained below referring to the drawings, wherein.

DETAILED DESCRIPTION OF THE PREFERRED EMBODIMENTS

Figure 1:
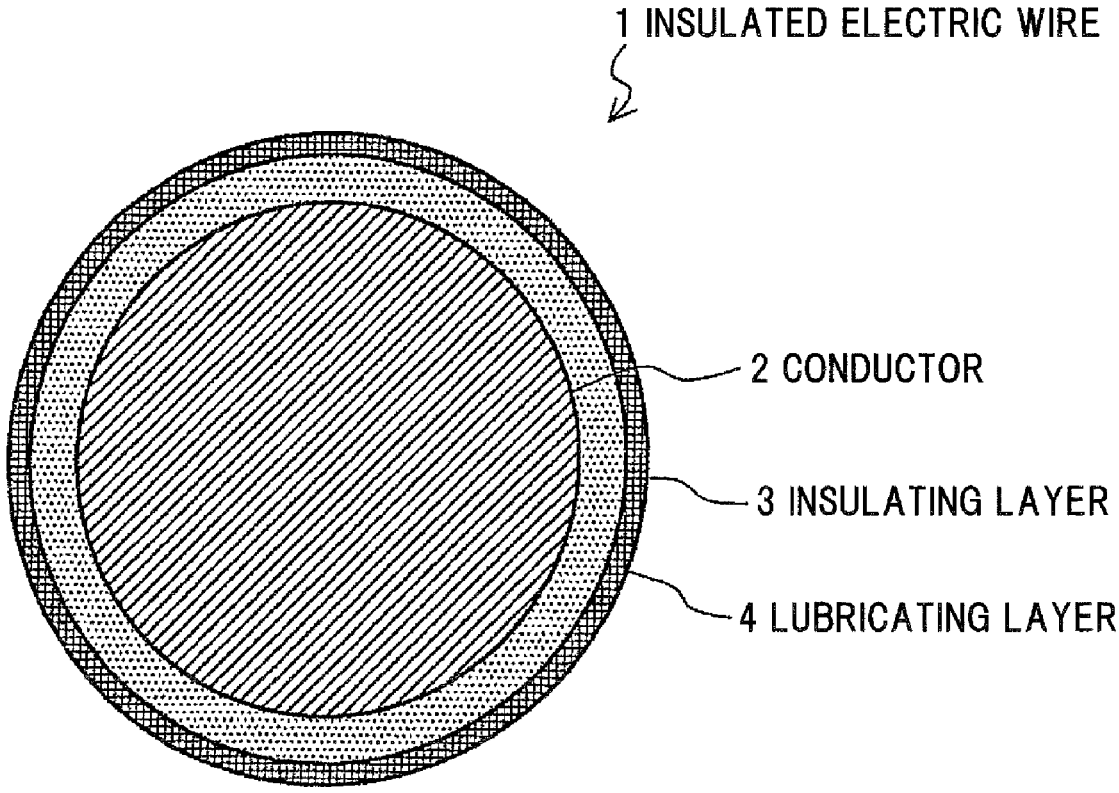
FIG. 1 is a cross-sectional view showing an insulated electric wire in one preferred embodiment according to the invention.

Below is described one preferred embodiment according to the invention, referring to FIG. 1.

Insulated Electric Wire Construction

FIG. 1 is a cross-sectional view showing an insulated electric wire in one preferred embodiment according to the invention.

As shown in FIG. 1, insulated electric wire (enameled wire) 1 is constructed by forming, sequentially around the perimeter of a conductor 2, an insulating layer 3, and a lubricating layer (self-lubricating layer) 4.

Insulating Layer 3

The insulating layer 3 comprises, for example a lower insulating layer formed with a polyester-imide coating applied to and baked around the perimeter of the conductor 2, and an upper insulating layer formed with a polyamide-imide coating applied to and baked around the perimeter of the lower insulating layer.

Lubricating Layer 4

The lubricating layer 4 is formed by applying to and baking around the perimeter of the insulating layer 3 (upper insulating layer) a resin coating (self-lubricating coating) with at least a lubricant, a titanate coupling agent, and a cross-linking agent added to its base resin.

Base Resin

The base resin used in the resin coating may most suitably use a polyamide-imide resin. The polyamide-imide resin production method is not particularly limited, but may use immediate reaction of a tricarboxylic acid anhydride and diisocyanates in a polar solvent, or use reaction of a tricarboxylic acid anhydride and diamines in a polar solvent to form imide bonds followed by subsequent reaction with diisocyanates to form amide bonds.

Lubricant

The lubricant is for lubricating (self-lubricating) the base resin, and may use a mixture of one or two or more selected from among polyolefin waxes, fatty acid ester-based waxes, etc. The polyolefin waxes may use a low-molecular weight polyolefin (polyethylene series, polypropylene series), an oxidized polyethylene, etc., which have preferably an average molecular weight of 1000 to 10000. This is because the average molecular weight smaller than 1000 causes insufficient lubrication and therefore poor coil insertability, while the average molecular weight greater than 10000 causes a cloudy coating, or a noticeably poor appearance of insulated electric wire 1, such as a foamy, granular, rough, or hollow surface.

The amount of the lubricant to be added is not particularly limited as long as it does not go beyond the range of the later-described absorbance ratio A1/A2 or effective lubricating area, but is desirably 1 to 10 parts by mass relative to 100 parts by mass of base resin. This is because the amount of the lubricant to be added smaller than 1 part by mass causes insufficient lubrication and therefore poor coil insertability, while the amount of the lubricant to be added greater than 10 parts by mass causes a cloudy coating, or a noticeably poor appearance of insulated electric wire 1, such as a foamy, granular, rough, or hollow surface.

Titanate Coupling Agent

The titanate coupling agent serves as a lubricant and is therefore added to lubricate the base resin.

A titanate coupling agent is preferably used which has a hydrophilic group and a lipophilic group which bond to titanium atoms. For example, the titanate coupling agent may be isopropyl trioctanoyl titanate, isopropyl triisostearoyl titanate, isopropyl trioleoyl titanate, isopropyl tripalmitoyl titanate, isopropyl tridodecyl benzene sulfonyl titanate, isopropyl tri(dioctyl pyrophosphate)titanate, isopropyl dimethacryl isostearoyl titanate, isopropyl isostearoyl diacryl titanate, isopropyl tri(dioctyl phosphate)titanate, bis(dioctyl pyrophosphate) oxyacetate titanate, bis(dioctyl pyrophosphate) ethylene titanate, diisostearoyl ethylene titanate, tetraisopropyl bis(dioctyl phosphite)titanate, tetraoctyl bis(ditridecyl phosphite)titanate, tetra(2,2-diallyloxymethyl-1-butyl)bis(ditridecyl phosphite)titanate, etc.

The amount of the titanate coupling agent to be added is not particularly limited as long as it does not go beyond the range of the later-described absorbance ratio A1/A2, effective lubricating area, and the mass ratio of the titanate coupling agent and cross-linking agent, but is desirably 0.1 to 10 parts by mass relative to 100 parts by mass of base resin. This is because the amount of the titanate coupling agent to be added smaller than 0.1 parts by mass causes insufficient lubrication and therefore poor coil insertability, while the amount of the titanate coupling agent to be added greater than 10 parts by mass causes a cloudy coating, or a noticeably poor appearance of insulated electric wire 1, such as a foamy, granular, rough, or hollow surface.

Cross-Linking Agent

The cross-linking agent serves to reduce the hardness of the coating (lubricating layer 4) when hardened by baking to accelerate lubricant bleed, and may use a polyisocyanate compound.

The polyisocyanate compound to be used as the cross-linking agent may be terminated with two or more isocyanate groups, whether or not the isocyanate groups are stabilized by a masking agent, but it is preferred that the isocyanate groups be not stabilized by the masking agent.

This is because use of polyisocyanate compounds with isocyanate groups stabilized by the masking agent has no cross-linking effect without the masking agent being unmasked due to an external factor such as heat, and therefore causes difficulty controlling the baking temperature in the production process, whereas use of polyisocyanate compounds with isocyanate groups not stabilized by the masking agent is more likely to allow the progress of the cross-linking and therefore the control of the baking temperature in the production process than stabilized polyisocyanate compounds, i.e., because use of polyisocyanate compounds with isocyanate groups not stabilized allows the cross-linking effect to be more easily obtained than in the past and therefore also the effect of enhancing the productive efficiency to be expected.

The polyisocyanate compound not stabilized may be added to the base resin by, for example causing a reaction of two or more-hydroxyl-terminated alcohol and diphenyl methane diisocyanate to produce a polyisocyanate compound, and adding the polyisocyanate compound to the base resin with its isocyanate groups not stabilized by a masking agent.

The two or more-hydroxyl-terminated alcohol may use ethylene glycol, diethylene glycol, glycerin, diglycerin, trimethylolpropane, pentaerythritol, or the like, but is not limited thereto.

Although it is assumed that the use of the polyisocyanate compound not stabilized causes the resin coating to thicken with time, this is overcome by adding the masking agent to the resin coating beforehand, thus allowing the polyisocyanate compound not stabilized to have a similar effect to that of a stabilized polyisocyanate compound.

The masking agent added to the resin coating beforehand may use methanol, ethanol, phenol, cresol, xylenol, MEK oxime, or the like, but is not limited thereto.

As the stabilized polyisocyanate compound, there are "Desmodur® AP stabil" and "Desmodur® CT stabil," Sumitomo Bayer Urethane Company, Ltd., "Millionate® MS-50" and "CORONATE® 2503," Nippon Polyurethane Industry Co. Ltd., and the like.

The amount of the polyisocyanate compound to be added is not particularly limited as long as it does not go beyond the range of the later-described absorbance ratio A1/A2, effective lubricating area, and the mass ratio of the titanate coupling agent and cross-linking agent (polyisocyanate compound), but is desirably 1 to 200 parts by mass relative to 100 parts by mass of base resin. This is because the amount of the polyisocyanate compound to be added smaller than 1 part by mass causes insufficient lubrication and therefore poor coil insertability, while the amount of the polyisocyanate compound to be added greater than 200 parts by mass causes a cloudy coating, or a noticeably poor appearance of insulated electric wire 1, such as a foamy, granular, rough, or hollow surface.

Also, the mass ratio of the titanate coupling agent and the cross-linking agent (polyisocyanate compound) is preferably 1:10 to 1:200. This is because the mass ratio of the titanate coupling agent and the cross-linking agent greater than 1:10 causes insufficient lubrication and therefore poor coil insertability, while the mass ratio of the titanate coupling agent and the cross-linking agent smaller than 1:200 causes a cloudy coating, or a noticeably poor appearance of insulated electric wire 1, such as a foamy, granular, rough, or hollow surface.

Absorbance Ratio A1/A2

Now, the insulated electric wire 1 in this embodiment is not less than 0.06 and not more than 0.12 in the absorbance ratio A1/A2 expressed by the absorbance A1 of carbon-hydrogen stretching vibration and the absorbance A2 of benzene ring framework vibration, obtained by Fourier Transform Infrared Spectroscopy analysis of surface of the outermost lubricating layer 4 of the insulated electric wire 1.

More specifically, when observing the outermost surface of the lubricating layer 4 by use of the Fourier Transform Infrared Spectrometer (FT-IR)-Attenuated Total Reflection (ATR) method and multivariate analysis removing noise, the absorbance ratio A1/A2, which is defined as the absorbance A1 at a frequency of 2925 $cm^{-1}$ (wavelength 3.4 μm) of carbon-hydrogen stretching vibration of a methylene group divided by the absorbance A2 at a frequency of 1510 $cm^{-1}$ (wavelength 6.6 μm) of benzene ring framework vibration, is not less than 0.06 and not more than 0.12.

Since the carbon-hydrogen stretching vibration comes from the lubricant (e.g., polyolefin wax), and the benzene ring framework vibration comes from the base resin (polyamide-imide resin), the absorbance ratio A1/A2 represents the proportion of the lubricating component (lubricant) to the base resin in surface of the lubricating layer 4.

The reason for the absorbance ratio A1/A2 being not less than 0.06 and not more than 0.12 is because the absorbance ratio A1/A2 smaller than 0.06 is likely to cause the lubricant insufficient bleed over the surface of the lubricating layer 4, or the lubricant thermolysis during resin coating baking, therefore insufficient lubrication and poor coil insertability, while the absorbance ratio A1/A2 greater than 0.12 may cause the lubricant excessive presence over the surface of the lubricating layer 4, therefore a cloudy coating of the surface of the lubricating layer 4, or a noticeably poor appearance of insulated electric wire 1, such as a foamy, granular, rough, or hollow surface.

Effective Lubricating Area

Also, when measuring the absorbance ratio A1/A2 over a specified range of the surface of the lubricating layer 4 (e.g., a surface area of 400 μm×400 μm of the insulated electric wire 1), the effective lubricating area is defined as the proportion of the area having an absorbance ratio A1/A2 of not less than 0.06 and not more than 0.12 relative to the measured area.

This effective lubricating area is preferably not less than 7% and not more than 70% relative to the measured area. This is because the effective lubricating area smaller than 7% causes insufficient lubrication and therefore poor coil insertability, while the effective lubricating area greater than 70% causes a cloudy coating, or a noticeably poor appearance of insulated electric wire 1, such as a foamy, granular, rough, or hollow surface.

Functions of the Embodiment

The functions of this embodiment are explained.

The insulated electric wire 1 in this embodiment is not less than 0.06 and not more than 0.12 in the absorbance ratio A1/A2 expressed by the absorbance A1 of carbon-hydrogen stretching vibration and the absorbance A2 of benzene ring framework vibration, obtained by Fourier Transform Infrared Spectroscopy analysis of surface of the lubricating layer 4.

The absorbance ratio A1/A2 not less than 0.06 can inhibit insufficient lubricant bleed over the surface of the lubricating layer 4, or lubricant thermolysis during baking, therefore allowing the lubricating layer 4 to be formed to have a sufficient surface lubricity, and thereby make the coil insertability good.

Also, the absorbance ratio A1/A2 not more than 0.12 can prevent excessive lubricant presence over the surface of the lubricating layer 4, so that the insulated electric wire 1 has a good appearance.

Accordingly, the absorbance ratio A1/A2 not less than 0.06 and not more than 0.12 allows realization of insulated electric wire 1 with an excellent coil insertability, and a cloudless coating and a flawless appearance.

Further, in this embodiment, the effective lubricating area of the surface of the lubricating layer 4 is not less than 7% and not more than 70%.

When the effective lubricating area of the surface of insulated electric wire 1, i.e., the surface of the lubricating layer 4 is greater than 70%, the lubricant is excessive on portion of the surface of the lubricating layer 4, therefore causing a poor appearance of insulated electric wire 1. Conversely, when the effective lubricating area is smaller than 7%, the coil insertability is likely to be insufficient. By setting the effective lubricating area at not less than 7% and not more than 70%, however, neither a deterioration of the coil insertability due to insufficient lubrication, nor a poor appearance of insulated electric wire 1 due to the surface of lubricating layer 4 being cloudy, foamy, granular, rough, or hollow, is caused.

Also, in this embodiment, the resin coating used as lubricating layer 4 uses the polyamide-imide resin added with at least the lubricant, the titanate coupling agent and the cross-linking agent, and the mass ratio of the titanate coupling agent and the cross-linking agent is 1:10 to 1:200.

As stated above, the polyisocyanate compound used as the cross-linking agent serves to reduce the hardness of the coating (lubricating layer 4) when hardened by baking to accelerate lubricant bleed, while the titanate coupling agent serves as a lubricant and is therefore added to lubricate the base resin.

At a glance, it is assumed that when decreasing the hardness of the coating (lubricating layer 4), adding the inorganic titanate coupling agent causes an increase of the hardness of the coating (lubricating layer 4). However, it is presumed that the titanate coupling agent does not inhibit the property of the polyisocyanate compound in the added mass ratio range above, but allows its hydrophilic moiety to react with and bond to the base resin to give the base resin the lipophilic property of the titanate coupling agent, therefore making the lubricant bleed easier.

Namely, setting the mass ratio of the titanate coupling agent and the cross-linking agent (polyisocyanate compound) at 1:10 to 1:200 allows the lubricant bleed to be made easier by the synergy effect of the titanate coupling agent and the polyisocyanate compound, therefore permitting a significantly enhanced surface lubricity of the lubricating layer 4 and an improved coil insertability of insulated electric wire 1.

Further, in this embodiment, the cross-linking agent uses a polyisocyanate compound terminated with isocyanate groups not stabilized by a masking agent. This allows the progress and effect of the cross-linking to be facilitated in comparison with stabilized polyisocyanate compounds used in the past, therefore permitting an enhanced productive efficiency, and also facilitating the control of the baking temperature in the production process.

Although in the above embodiment, the base resin of the resin coating uses the polyamide-imide resin, it is not limited thereto, but may use a polyamide resin, polyimide resin, polyester resin, or polyesterimide resin, to thereby achieve a similar effect.

Also, although in the above embodiment, the insulating layer 3 is comprised of two lower and upper insulating layers, it may be one layer formed of a polyesterimide resin, and be formed with lubricating layer 4 around the perimeter of the insulating layer 3.

EXAMPLES

Next are explained advantages of the present invention, by way of Examples and Comparative examples.

Insulated electric wires in Examples and Comparative examples are produced as follows.

Around the perimeter of a 0.8 mm-diameter copper conductor 2 is formed a 25 μm-thick lower insulating layer by applying and baking of a polyesterimide coating EH-402-40 (Dainichiseika Color & Chemicals Mfg. Co., Ltd.). On top of the lower insulating layer is formed a 5 μm-thick upper insulating layer by applying and baking of a polyamide-imide coating HI-406-30 (Hitachi Chemical Co., Ltd.). This results in a base wire formed with insulating layer 3 with a total coating thickness of 30 μm. On top of this base wire is applied and baked each resin coating shown in Table 1 to have a coating thickness of 3 μm. This results in the insulated electric wires in Examples 1-4 and Comparative examples 1 and 2.

TABLE 1

(Combination: part by mass)

| | Example 1 | Example 2 | Example 3 | Example 4 | Comparative example 1 | Comparative example 2 |
|---|---|---|---|---|---|---|
| ① Polyamide-imide (base resin) | 100.0 | 100.0 | 100.0 | 100.0 | 100.0 | 100.0 |
| ② Hiwax 110P (lubricant) | 3.0 | 3.0 | 3.0 | 3.0 | 3.0 | 3.0 |
| ③ Plenact KR 41B (titanate coupling agent) | 1.0 | 0.1 | 1.0 | 10.0 | 1.0 | 1.0 |
| ④ Polyisocyanate compound (cross-linking agent) | 50.0 | 1.0 | 200.0 | 200.0 | 5.0 | 300.0 |
| ③:④ (mass ratio) | 1:50 | 1:10 | 1:200 | 1:20 | 1:5 | 1:300 |
| Absorbance ratio A1/A2 | 0.08 | 0.08 | 0.08 | 0.08 | 0.08 | 0.08 |
| Effective lubricating area (%) | 35 | 57 | 45 | 30 | 1 | 77 |
| Coil insertability (kN) | 4.5 | 4.5 | 4.5 | 4.7 | 5.6 | 4.3 |
| Appearance | Good | Good | Good | Good | Good | Poor |

For each insulated electric wire produced, the coil insertability is measured with a load cell for evaluating an inserting force of a coil-inserting machine TZ-E (Toyo Gauge Co., Ltd.) inserting into a core the wire coil produced to have a fill factor of 70% using a flyer-type wire-coiling machine DTW-T2N (Hibo Engineering Ltd.).

Also, for each insulated electric wire, the absorbance ratio A1/A2 of the outermost surface of its lubricating layer 4 is measured by use of the Fourier Transform Infrared Spectrometer (FT-IR)-Attenuated Total Reflection (ATR) method and multivariate analysis removing noise. The measurement is made by use of a Bio-Rad FTS-40A FT-IR Spectrometer taking the surface area of each insulated electric wire as 20 μm×20 μm at 64 scans and a resolving power of 4 $cm^{-1}$. From the relationship between infrared wavelength and measurement depth, the measurement depth is 0.2 μm at 4000 $cm^{-1}$ and 0.9 μm at 700 $cm^{-1}$.

The effective lubricating area of the surface of the lubricating layer 4 is also measured by use of the Fourier Transform Infrared Spectrometer (FT-IR)-Attenuated Total Reflection (ATR) method and multivariate analysis removing noise. The measurement is made by use of a Perkin-Elmer Spectrum 100 FTIR Spectrometer and Spotlight 400 taking the surface area of each insulated electric wire as 400 μm×400 μm at 1 scan and a resolving power of 8 $cm^{-1}$.

Example 1

The resin coating in Example 1 is produced by adding to 100 parts by mass of polyamide-imide coating HI-406-30 (Hitachi Chemical Co., Ltd.) 3 parts by mass of "Hiwax 110P" (from Mitsui Petrochemical Industries, Ltd.) relative to the polyamide-imide resin content in the polyamide-imide coating as a lubricant, 1 part by mass of "Plenact KR 41B" (from Ajinomoto Fine-Techno Co., Inc.) relative to the polyamide-imide resin content as a titanate coupling agent, and 50 parts by mass of polyisocyanate compound not stabilized by causing a mole ratio of 1:3 of trimethylolpropane and diphenyl methane diisocyanate to react in a polar solvent relative to the polyamide-imide resin content as a polyisocyanate compound. The mass ratio of the titanate coupling agent and the cross-linking agent (polyisocyanate compound) is 1:50. This resin coating is applied and baked on the base wire, thereby forming lubricating layer 4. This results in insulated electric wire 1 in Example 1.

Example 2

Insulated electric wire 1 in Example 2 is produced in the same manner as in Example 1, except that the amount of the titanate coupling agent is 0.1 parts by mass, and the amount of the polyisocyanate compound is 1.0 part by mass. The mass ratio of the titanate coupling agent and the cross-linking agent in the resin coating in Example 2 is 1:10.

Example 3

Insulated electric wire 1 in Example 3 is produced in the same manner as in Example 1, except that the amount of the titanate coupling agent is 1.0 part by mass, and the amount of the polyisocyanate compound is 200.0 parts by mass. The mass ratio of the titanate coupling agent and the cross-linking agent in the resin coating in Example 3 is 1:200.

Example 4

Insulated electric wire 1 in Example 4 is produced in the same manner as in Example 1, except that the amount of the titanate coupling agent is 10.0 parts by mass, and the amount of the polyisocyanate compound is 200.0 parts by mass. The mass ratio of the titanate coupling agent and the cross-linking agent in the resin coating in Example 4 is 1:20.

Comparative Example 1

The insulated electric wire in Comparative example 1 is produced in the same manner as in Example 1, except that the amount of the titanate coupling agent is 1.0 part by mass, and the amount of the polyisocyanate compound is 5.0 parts by mass. The mass ratio of the titanate coupling agent and the cross-linking agent in the resin coating in Comparative example 1 is 1:5.

Comparative Example 2

The insulated electric wire in Comparative example 2 is produced in the same manner as in Example 1, except that the amount of the titanate coupling agent is 1.0 part by mass, and the amount of the polyisocyanate compound is 300.0 parts by mass. The mass ratio of the titanate coupling agent and the cross-linking agent in the resin coating in Comparative example 2 is 1:300.

Results of evaluating Examples 1-4 and Comparative examples 1 and 2 are tabulated in Table 1.

As shown in Table 1, the insulated electric wires 1 in Examples 1-4 produced according to the present invention exhibit the good coil insertability and good appearance. In contrast, the insulated electric wire in Comparative example 1 with the mass ratio of the titanate coupling agent and the cross-linking agent (polyisocyanate compound) being 1:5 has the poor coil insertability, and the insulated electric wire in Comparative example 2 with the mass ratio of the titanate coupling agent and the cross-linking agent (polyisocyanate compound) being 1:300 worsens in appearance.

The insulated electric wires 1 thus produced in Examples 1-4 have both the excellent coil insertability and good appearance.

Although the invention has been described with respect to the above embodiments, the above embodiments are not intended to limit the appended claims. Also, it should be noted that not all the combinations of the features described in the above embodiments are essential to the means for solving the problems of the invention.

What is claimed is:

1. An insulated electric wire, comprising:

a conductor; and a lubricating layer containing a lubricant, formed around a perimeter of the conductor, and being not less than 0.06 and not more than 0.12 in an absorbance ratio A1/A2 expressed by an absorbance A1 of carbon-hydrogen stretching vibration and an absorbance A2 of benzene ring framework vibration, obtained by Fourier Transform Infrared Spectroscopy analysis of a surface of the lubricating layer.

2. The insulated electric wire according to claim 1, wherein the lubricating layer is not less than 7% and not more than 70% in an effective lubricating area of a surface thereof.

3. The insulated electric wire according to claim 1, wherein the lubricating layer comprises the lubricant, a titanate coupling agent, and a cross-linking agent, each added to a base resin.

4. The insulated electric wire according to claim 3, wherein the cross-linking agent comprises a polyisocyanate compound terminated with isocyanate groups not stabilized by a masking agent.

5. The insulated electric wire according to claim 3, wherein a mass ratio of the titanate coupling agent and the cross-linking agent is 1:10 to 1:200.

* * * * *